US008591838B2

(12) United States Patent
Bulow et al.

(10) Patent No.: US 8,591,838 B2
(45) Date of Patent: Nov. 26, 2013

(54) CASSETTE FOR TEST TUBES

(75) Inventors: Per-Anders Bulow, Uppsala (SE); Johan Carlsson, Kungsangen (SE); Sebastian Karlsson, Sundbyberg (SE); Lars Rosengren, Uppsala (SE); Henrik Svanberg, Uppsala (SE)

(73) Assignee: GE Healthcare Bio-Sciences AB, Uppsala (SE)

( * ) Notice: Subject to any disclaimer, the term of this patent is extended or adjusted under 35 U.S.C. 154(b) by 268 days.

(21) Appl. No.: 12/747,925

(22) PCT Filed: Dec. 8, 2008

(86) PCT No.: PCT/SE2008/000687

§ 371 (c)(1), (2), (4) Date: Jun. 14, 2010

(87) PCT Pub. No.: WO2009/078779

PCT Pub. Date: Jun. 25, 2009

(65) Prior Publication Data

US 2010/0272614 A1 Oct. 28, 2010

(30) Foreign Application Priority Data

Dec. 14, 2007 (SE) ..... 0702804

(51) Int. Cl.
*B01L 9/06* (2006.01)

(52) U.S. Cl.
USPC ..... 422/562

(58) Field of Classification Search
USPC ..... 422/560–562
See application file for complete search history.

(56) References Cited

U.S. PATENT DOCUMENTS

| | | | | |
|---|---|---|---|---|
| 2,979,210 | A | 4/1961 | Patterson | |
| 5,651,941 | A * | 7/1997 | Stark et al. | 422/562 |
| 6,132,684 | A | 10/2000 | Marino | |
| 2003/0215365 | A1 | 11/2003 | Sevigny et al. | |
| 2006/0266719 | A1 | 11/2006 | Knight et al. | |

FOREIGN PATENT DOCUMENTS

| | | |
|---|---|---|
| DE | 30 03 932 C2 | 8/1981 |
| DE | 87 07 894 | 8/1987 |
| EP | 0 022 988 | 4/1983 |
| EP | 0 409 776 | 1/1991 |
| NL | 1003725 | 2/1998 |
| WO | WO 98/05427 | 2/1998 |

OTHER PUBLICATIONS

Extended European Search Report on Corresponding Application No. 08862726.0 Dated Aug. 26, 2011.

* cited by examiner

*Primary Examiner* — Paul Hyun

(57) ABSTRACT

In a cassette for test tubes for use e.g. in a fraction collector the test tubes are kept in a fixed position by means of flexible springs arranged on an adjustable hold and release plate, which, when moved to its release position, releases the test tubes.

7 Claims, 3 Drawing Sheets

CASSETTE FOR TEST TUBES

CROSS-REFERENCE TO RELATED APPLICATIONS

This application is a filing under 35 U.S.C. §371 and claims priority to international patent application No. PCT/SE2008/000687 filed Dec. 8, 2008, published on Jun. 25, 2009, as WO 2009/078779, which claims priority to patent application No. 0702804-6 filed in Sweden on Dec. 14, 2007.

FIELD OF THE INVENTION

The present invention pertains to the field of cassettes for test tubes, typically cassettes for use in a fraction collector e.g. in an HPLC (High Pressure Liquid Chromatography) system.

BACKGROUND OF THE INVENTION

Cassettes for test tubes are widely used in many applications such as fraction collectors. A fraction collector is used for dispensing a flow of liquid into a number of receptacles, such as test tubes. Normally the test receptacles are fed towards a dispensing means by means of a relative movement in one or two directions. As the droplets dispensed can have a diameter of 4 millimeters and the smallest tubes have an orifice of 6.7 millimeter it is important that the tubes are held in exactly the right position to avoid spilling. To allow for different tube manufacturers and account for the tolerances in their production the tubes are normally spring loaded which is also an advantage when emptying all test tubes of waste fluid after use.

However, the spring load introduces a force which the user has to overcome when loading the cassettes and after emptying the cassette of waste fluid the empty tubes are normally put in another container for further processing. Since the tubes are vertically fixed this has to be made manually test tube by test tube which is very cumbersome and annoying. Thus there is a need for a cassette in which the test tubes are normally held in a fixed position vertically and horizontally but where the test tubes can also easily be released when loading the cassette and emptying the cassette of test tubes.

SUMMARY OF THE INVENTION

In a first aspect it is an object of the present invention to provide for a cassette for test tubes where the test tubes are normally held in a fixed position but where all test tubes simultaneously can be released when loading or emptying the cassette. A cassette meeting this aspect is defined in claim 1 of the appended claims.

According to a further aspect of the invention there is provided a cassette which has a bi-stable hold and release function so as to have the test tubes held or released in a stable position, as claimed in claims 3 and 4 of the appended claims.

Further scope of applicability of the present invention will become apparent from the detailed description given hereinafter. However it should be understood that a detailed description and specific examples while indicating preferred embodiments of the invention are given by way of illustration only. There are changes and modifications within the spirit and scope of the invention will become apparent to those skilled in the art from the detailed description below.

Specifically it should be noted that the use of the cassette of the invention is illustrated for a fraction collector. However it is useful in many other fields of application where there is a desire to use a cassette for test tubes in which the test tubes are normally held in a fixed position but can easily and simultaneously be released therefrom.

DETAILED DESCRIPTION OF THE INVENTION

Figure 1:
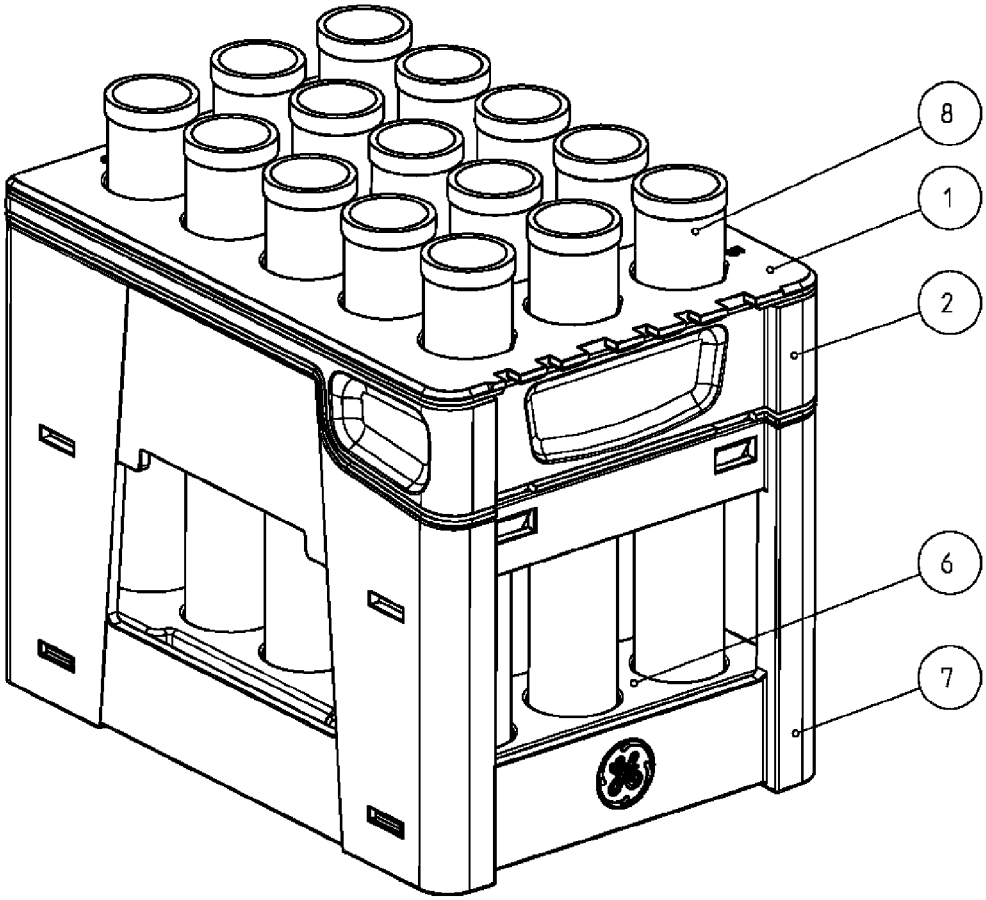
FIG. 1 is a perspective view of a cassette according to the invention.
Figure 2:
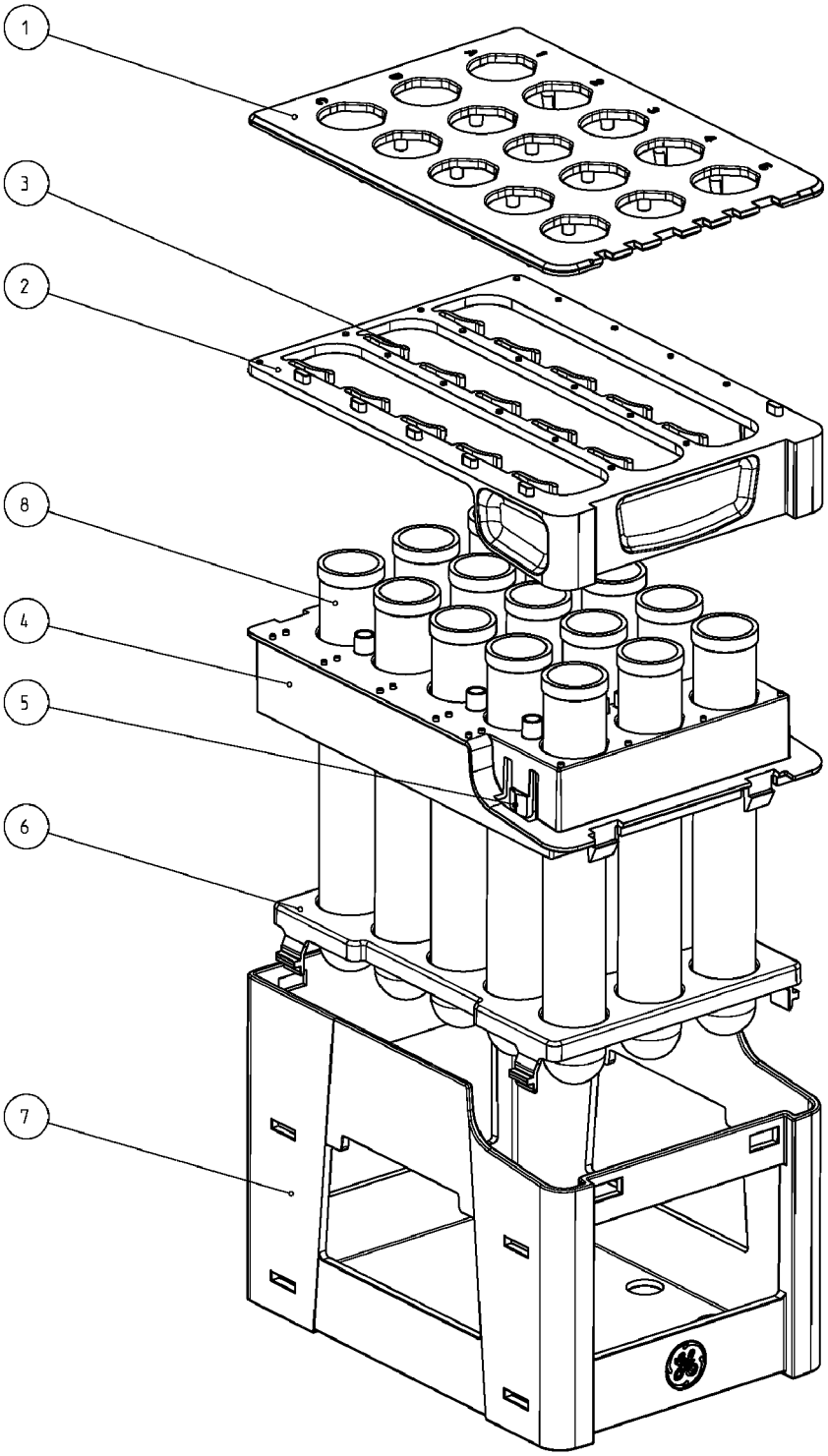
FIG. 2 is a partly exploded view of the components of the cassette of FIG. 1.
Figure 3:
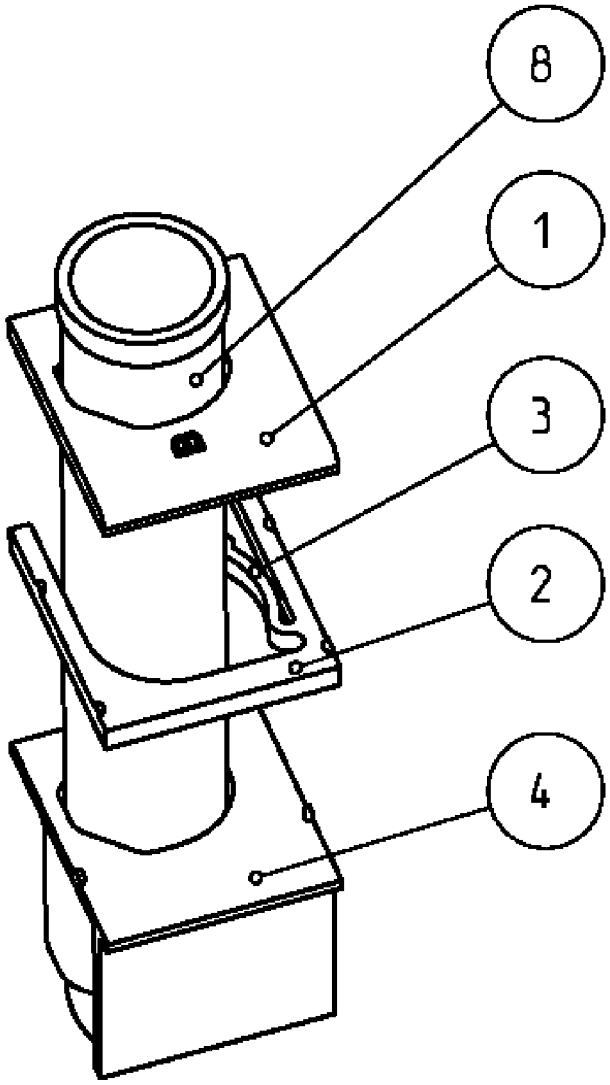
FIG. 3 is a perspective view of a single test tube in the cassette according to FIG. 1 and FIG. 2 and the different components guiding and supporting it.

In FIGS. 1, 2 and 3 where the different numerals denote common components, reference 7 denotes a cassette base of a cassette holding a plurality of test tubes 8. The cassette comprises a top plate 1 and a bottom guide plate 6. The cassette according to the invention further comprises a support plate 4 for a hold and release plate 2. The hold and release plate is provided with springs 3, for holding the test tubes in a fixed position vertically and horizontally. The hold and release plate 2 is horizontally adjustable in two stable positions and held in these positions by means of an index spring, 5. When the hold and release plate 2 is fully inserted each spring is strained and all tubes are fixed vertically and horizontally and the tubes will have the right position for avoiding spilling. When the plate takes this position it will also be easy to empty all the cassettes of waste fluid.

When the plate is fully withdrawn, i.e. in its second stable position, each spring is released, hence allowing the user easily to fill the cassettes with tubes. After a run when the tubes have been emptied of waste fluid, the plate can be withdrawn and all test tubes released from the cassette simultaneously for further processing.

The invention as described above by way of an example could obviously be varied in many ways. Such variations are not to be regarded as a departure from the spirit and scope of the invention and all such modifications as would be obvious to one skilled in the art are intended to be included in the scope of the following claims.

What is claimed is:

1. A cassette for holding a plurality of test tubes comprising:

a base (7);

a support plate (4); and an adjustable hold and release plate (2) moveable relative to the support plate (4) into either a first test tube hold position or a second release position, said plate being provided with holding means (3) for holding said test tubes in a fixed position when the hold and release plate is in the first hold position and for releasing said test tubes when the hold and release plate is in the second position, wherein the hold and release plate together with the holding means is a unitary formation.

2. The cassette of claim 1, wherein the hold and release plate is horizontally adjustable.

3. The cassette of claim 2, wherein said holding means consists of flexible springs (3) for each test tube.

4. The cassette of claim 1, wherein the hold and release plate is stable in its first position.

5. The cassette of claim 1, wherein the hold and release plate is stable in its first and second position.

6. The cassette of claim 5, wherein the hold and release plate is kept stable in said first and second positions by means of an index spring (5).

7. A cassette for holding a plurality of test tubes comprising:

a base (7);

a support plate (4); and an adjustable hold and release plate (2) moveable relative to the support plate (4) into either a first test tube hold position or a second release position, said plate being provided with holding means (3) for holding said test tubes in a fixed position when the hold and release plate is in the first position and for releasing said test tubes when the hold and release plate is in the second position; and a top plate, wherein the hold and release plate (2) together with the holding means is a unitary formation, said unitary formation being slidable relative to the support plate into either of the said positions, and being urged into those positions by an index spring held on the support plate, and wherein the hold and release plate is slidable between the support plate and the top plate.

* * * * *